US011014325B2

(12) United States Patent
Takahashi

(10) Patent No.: US 11,014,325 B2
(45) Date of Patent: May 25, 2021

(54) SHEET BINDING PROCESSING APPARATUS AND IMAGE FORMING SYSTEM HAVING THE SAME

(71) Applicant: Masaya Takahashi, Yamanashi-ken (JP)

(72) Inventor: Masaya Takahashi, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 50 days.

(21) Appl. No.: 16/587,845

(22) Filed: Sep. 30, 2019

(65) Prior Publication Data

US 2020/0101688 A1 Apr. 2, 2020

(30) Foreign Application Priority Data

Oct. 2, 2018 (JP) ..... JP2018-187155

(51) Int. Cl.
*B31F 5/02* (2006.01)
*B65H 37/04* (2006.01)
(Continued)

(52) U.S. Cl.
CPC ..... *B31F 5/02* (2013.01); *B31F 1/07* (2013.01); *B65H 37/04* (2013.01); *G03G 15/6544* (2013.01); *B31F 2201/07* (2013.01); *B31F 2201/0754* (2019.01); *B42B 4/00* (2013.01); *B42C 1/12* (2013.01); *B65H 39/10* (2013.01); *B65H 2301/43828* (2013.01); *B65H 2801/27* (2013.01); *G03G 2215/00852* (2013.01)

(58) Field of Classification Search
CPC ..... B31F 1/07; B31F 5/02; B31F 2201/07; B31F 2201/0754; G03G 15/6544; G03G 2215/00852; B65H 37/04; B65H 2301/43828; B65H 2301/51616; B65H 2801/27
USPC ..... 270/58.07, 58.08
See application file for complete search history.

(56) References Cited

U.S. PATENT DOCUMENTS 9,321,293 B2 * 4/2016 Obuchi ..... B42B 4/00
9,731,536 B2 * 8/2017 Osada ..... B65H 37/04
(Continued)

FOREIGN PATENT DOCUMENTS

JP 2005-096392 A 4/2005
JP 2010-274623 A 12/2010
(Continued)

*Primary Examiner* — Leslie A Nicholson, III

(57) ABSTRACT

A sheet binding processing apparatus includes a transport section transporting a bunch of sheets in a transport direction, a sheet discharge outlet to discharge the bunch of sheets transported from the transport section, a placement section to place the bunch of sheets discharged from the discharge outlet, a manual set section enabling a bunch of sheets inserted in a direction different from the transport direction to be set, a press member pressing the bunch of sheets placed on the placement section or on the manual set section to bind, a drive section applying a pressing force to the press member, and a control section controlling the drive section to make the pressing force applied to a binding member higher in the case of binding the bunch of sheets placed on the placement section than in the case of binding the bunch of sheets set from the manual set section.

8 Claims, 13 Drawing Sheets

(51) Int. Cl.

| | |
|---|---|
| ***G03G 15/00*** | (2006.01) |
| ***B31F 1/07*** | (2006.01) |
| *B42C 1/12* | (2006.01) |
| *B65H 39/10* | (2006.01) |
| *B42B 4/00* | (2006.01) |

(56) References Cited

U.S. PATENT DOCUMENTS

| | | | | |
|---|---|---|---|---|
| 9,969,144 | B1 * | 5/2018 | Awano | B65H 37/04 |
| 10,029,880 | B2 * | 7/2018 | Ishihara | B31F 5/001 |
| 10,308,060 | B2 * | 6/2019 | Aoyagi | B65H 29/22 |

FOREIGN PATENT DOCUMENTS

| | | | |
|---|---|---|---|
| JP | 2012-047940 | A | 3/2012 |
| JP | 2015-016970 | A | 1/2015 |

* cited by examiner

MULTI-BINDING

RIGHT CORNER BINDING

LEFT CORNER BINDING

MANUAL BINDING

Cps; WAIT

Cpm; PRESSING START

Cpe; PRESSING END
140
141
142
143
144
130
131
132
133
133a
Wp
Ap
S
Cps
Cpm
Cpe

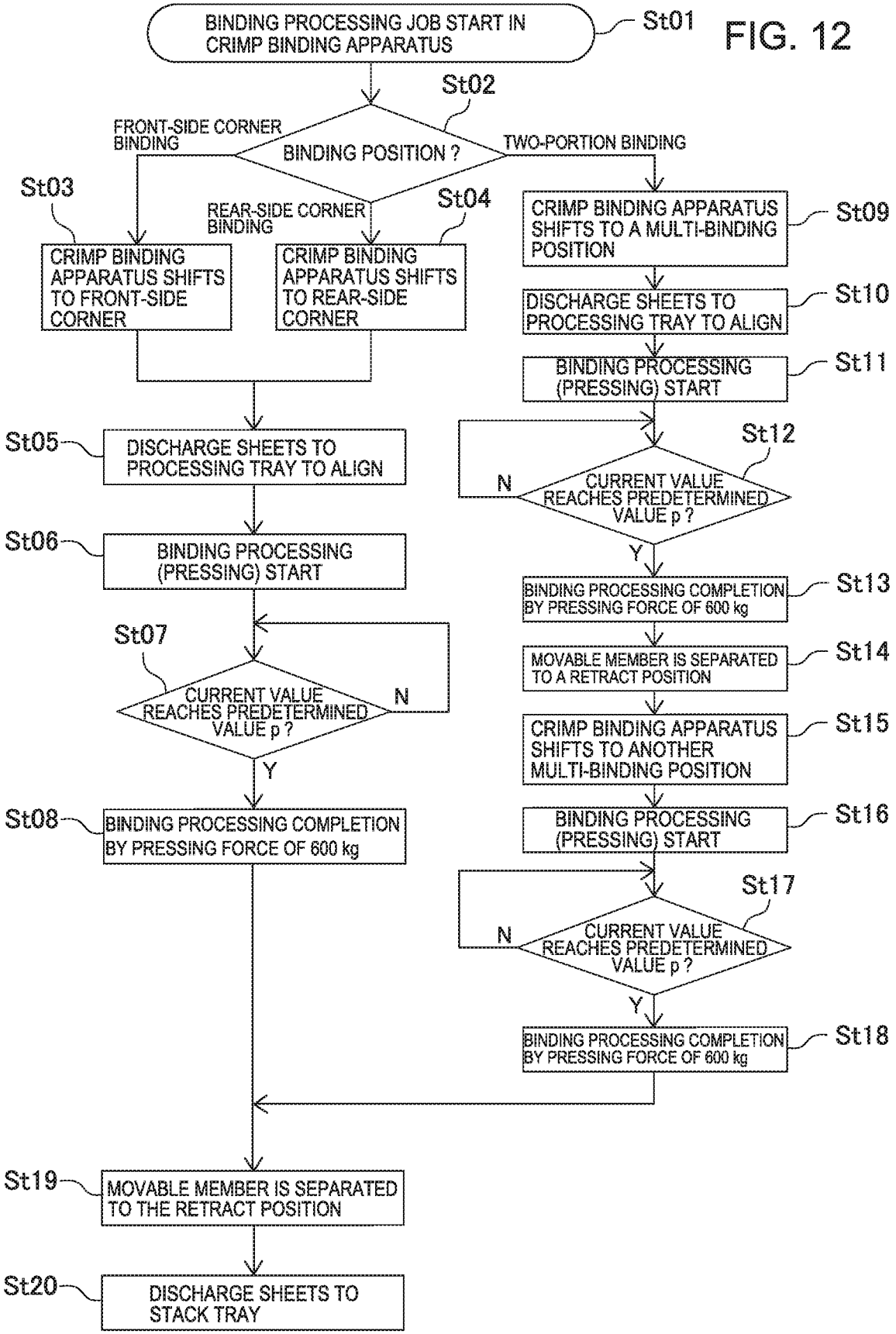
FIG. 12
BINDING PROCESSING JOB START IN CRIMP BINDING APPARATUS
St01
St02
BINDING POSITION ?
FRONT-SIDE CORNER BINDING
REAR-SIDE CORNER BINDING
TWO-PORTION BINDING
St03
St04
CRIMP BINDING APPARATUS SHIFTS TO FRONT-SIDE CORNER
CRIMP BINDING APPARATUS SHIFTS TO REAR-SIDE CORNER
St05
DISCHARGE SHEETS TO PROCESSING TRAY TO ALIGN
St06
BINDING PROCESSING (PRESSING) START
St07
CURRENT VALUE REACHES PREDETERMINED VALUE p ?
N
Y
St08
BINDING PROCESSING COMPLETION BY PRESSING FORCE OF 600 kg
St09
CRIMP BINDING APPARATUS SHIFTS TO A MULTI-BINDING POSITION
St10
DISCHARGE SHEETS TO PROCESSING TRAY TO ALIGN
St11
BINDING PROCESSING (PRESSING) START
St12
CURRENT VALUE REACHES PREDETERMINED VALUE p ?
N
Y
St13
BINDING PROCESSING COMPLETION BY PRESSING FORCE OF 600 kg
St14
MOVABLE MEMBER IS SEPARATED TO A RETRACT POSITION
St15
CRIMP BINDING APPARATUS SHIFTS TO ANOTHER MULTI-BINDING POSITION
St16
BINDING PROCESSING (PRESSING) START
St17
CURRENT VALUE REACHES PREDETERMINED VALUE p ?
N
Y
St18
BINDING PROCESSING COMPLETION BY PRESSING FORCE OF 600 kg
St19
MOVABLE MEMBER IS SEPARATED TO THE RETRACT POSITION
St20
DISCHARGE SHEETS TO STACK TRAY

SHEET BINDING PROCESSING APPARATUS AND IMAGE FORMING SYSTEM HAVING THE SAME

BACKGROUND OF THE INVENTION

1. Field of the Invention

The present invention relates to a sheet binding mechanism for performing binding processing on sheets, and to improvements in a press binding mechanism for crimping a plurality of sheets with a press member to tie.

2. Description of Related Arts

Generally, in this type of binding apparatus, known are a binding mechanism for performing binding processing on a bunch of collated and collected sheets with a staple, and another needleless binding mechanism for pressing a bunch of sheets by a press mechanism, and thereby applying mutual deformation to the sheets to tie. In the latter needleless binding mechanism, there are known characteristics that any binding tool made of metal and the like is not used, and that it is possible to easily peel off.

For example, in Patent Document 1 is disclosed a mechanism for collecting sheets sent from an image forming apparatus in the shape of a bunch, and crimping by a pair of upper and lower press members to tie. In the Document is disclosed a mechanism for coupling a press member on the fixed side having a concavo-convex face and a movable-side press member having another concavo-convex face engaging in the concavo-convex to a motor by a motion transfer mechanism such as a cam to drive.

Further, in Patent Document 2 is disclosed a mechanism for pressing a press lever (upper tooth-formed member 60A in the document) axially supported swingably to a fixed member (lower tooth-formed member) by a drive cam coupled to a motor (stepping motor). In this case, the Embodiment is described where the pressing force to press sheets is about 100 Kgf.

Furthermore, in Patent Document 3 is disclosed an apparatus which is provided with a stage having a slit-shaped groove to insert a bunch of sheets in a housing casing after collating and collecting sheets sent from an image forming apparatus on a stack tray, and which performs binding processing on a bunch of sheets inserted and set in the stage by an operator with a stapler apparatus inside the casing.

Still furthermore, in Patent Document 4 is disclosed a configuration for performing binding processing on sheets placed on a stack tray and manually set sheets, with a single movable stapler.

PATENT DOCUMENT

[Patent Document 1] Japanese Patent Application Publication No. 2012-047940

[Patent Document 2] Japanese Patent Application Publication No. 2010-274623

[Patent Document 3] Japanese Patent Application Publication No. 2005-096392

[Patent Document 4] Japanese Patent Application Publication No. 2015-016970

DISCLOSURE OF INVENTION

Problems to be Solved by the Invention

As described above, there is a widely known post-processing mechanism for collating, collecting sheets with images formed in an image forming apparatus in a post-processing apparatus to perform binding processing, and then, storing in a stack tray. Then, there is also a known apparatus for performing crimp binding processing on a bunch of sheets collected in a processing tray by a crimp binding processing mechanism.

Further, in Patent Document 3 and the like is proposed also the apparatus where the slit-shaped manual set stage is provided in the external housing casing of the binding processing apparatus, and an operator sets a bunch of sheets discharged to the stack tray on the set stage to perform binding processing.

Ordinarily, the binding processing by the needleless binding mechanism is to store in the stack tray after collating, collecting and performing the binding processing inside the post-processing apparatus, and therefore, needs to bind by a high pressing force so that the bound bunch is not spread out during transport.

On the other hand, in the case of binding manually set sheets by the above-mentioned crimp binding processing mechanism, since sheet transport is not required, as compared with the case of performing the binding processing inside the post-processing apparatus, any excessive pressing force is not required. Then, when the binding processing is performed by the same pressing force as inside the post-processing apparatus, a robust configuration is required to ensure durability of the binding apparatus, resulting causes of upsizing and high cost of the apparatus.

The inventor of the present invention noted the respect that a required pressing force is different between sheets with transport after binding processing and sheets without transport, in performing the binding processing on sheets by a crimp binding processing mechanism.

The present invention is to provide a sheet binding processing apparatus capable of suppressing occurrences of a sheet jam and a load imposed on a crimp binding processing mechanism, in the sheet binding processing apparatus capable of performing crimp binding processing with ordinary transport and crimp binding processing by manual insertion.

SUMMARY OF THE INVENTION

In order to attain the above-mentioned object, a sheet binding processing apparatus according to the present invention is provided with a transport section that transports a bunch of sheets in a predetermined transport direction, a sheet discharge outlet to discharge the bunch of sheets transported from the transport section, a placement section to place the bunch of sheets discharged from the discharge outlet, a manual set section that enables a bunch of sheets inserted in a direction different from the transport direction to be set, a press member that presses the bunch of sheets placed on the placement section or the bunch of sheets placed on the manual set section to bind, a drive section that applies a pressing force to the press member, and a control section that controls the drive section so as to make the pressing force applied to a binding member higher in the case of binding the bunch of sheets placed on the placement section than in the case of binding the bunch of sheets set from the manual set section.

In some Embodiment, the drive section is comprised of a motor, and is provided with a cam member for converting rotation of the motor into motion of the press member.

A cam face of the cam member for biasing the press member of this case preferably includes a helical shape so as to gradually increase the pressing force of the press member to the bunch of sheets. By this means, irrespective of whether a thickness of the bunch of sheets is different, it is possible to bias by the almost same pressing force.

Further, the apparatus is provided with a current value detecting circuit that detects a current value of the motor, and when the current value of the motor is increased as the press member increases the pressing force by action of the cam, the control section halts drive of the motor when the current value reaches a first predetermined value in the case of the bunch of sheets which is placed on the placement section and is set from the manual set section, while in the case where the bunch of sheets is a bunch of sheets discharged from the discharge outlet, halting drive of the motor when the current value reaches a second predetermined value higher than the first predetermined value.

Then, in an image forming system provided with an image forming unit for forming an image on a sheet, the sheet binding processing apparatus is used as a post-processing unit for performing the binding processing on sheets sent from the image forming unit.

BRIEF DESCRIPTION OF THE DRAWINGS

FIG. 12 shows an operation flow diagram of corner binding and multi-binding on a processing tray.

MODE FOR CARRYING OUT THE INVENTION

Figure 1:
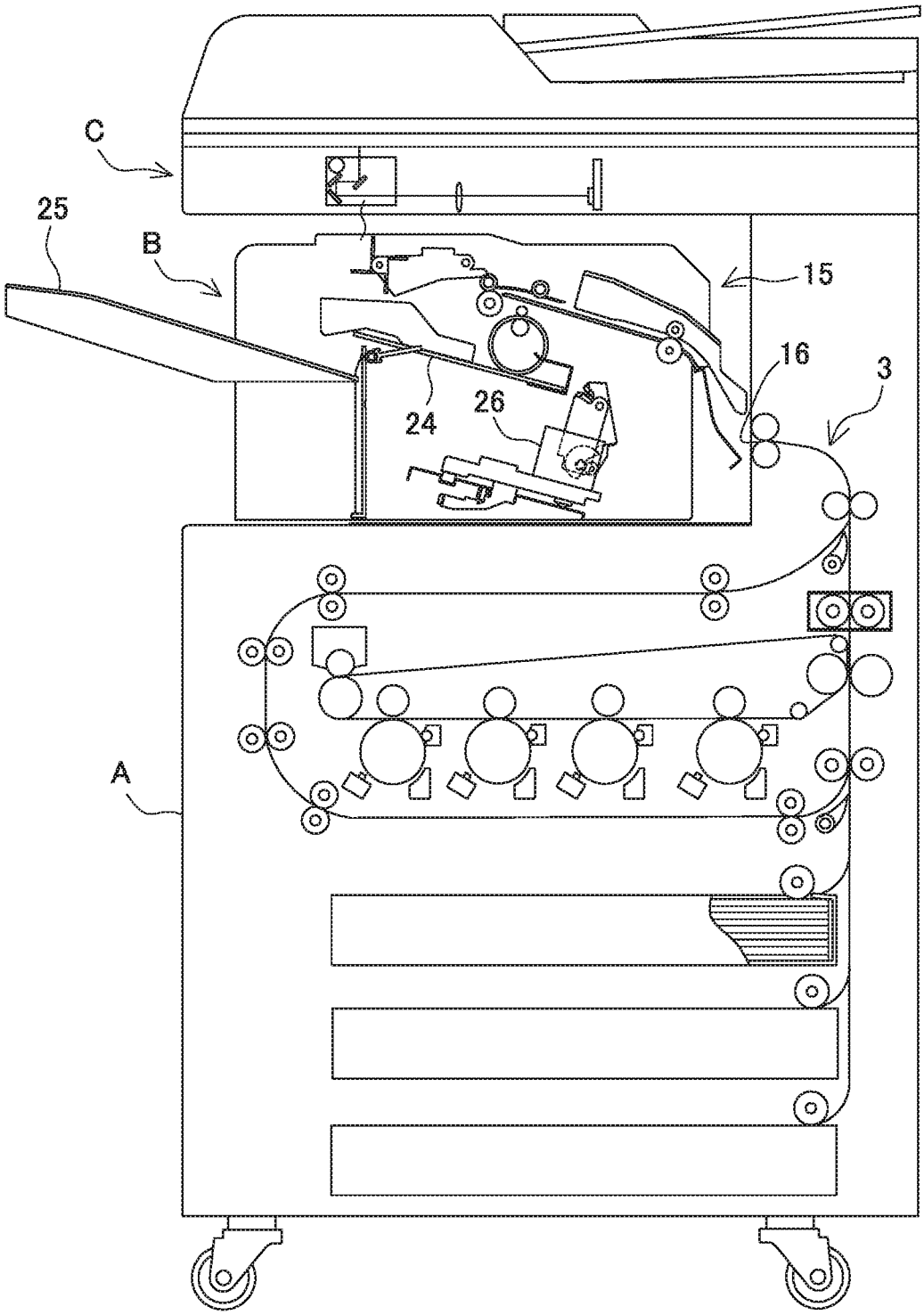
FIG. 1 shows a side elevational entire view of a post-processing apparatus and image forming apparatus.

The present invention will be described below in detail according to preferred Embodiments shown in the drawings. The present invention relates to a sheet bunch binding processing mechanism for performing binding processing on a bunch of sheets which are collated and collected after forming images thereon in an image forming system and the like described later. An image forming system shown in FIG. 1 is comprised of an image forming unit A, image reading unit C, and post-processing unit B. By such a configuration, an original document image is read by the image reading unit C, and based on the image data, an image is formed on a sheet by the image forming unit A. Then, the image-formed sheet is collated, collected, subjected to the binding processing by the post-processing unit B (sheet binding processing apparatus; the same hereinafter), and is stored in a stack tray 25 on the downstream side.

The post-processing unit B is incorporated, as a unit, into sheet discharge space (stack tray space) 15 formed in the housing of the image forming unit A, and is the sheet binding processing apparatus for collating image-formed sheets sent to a discharge outlet 16 on a processing tray 24 to collect, performing the binding processing, and then, storing in the stack tray 25 disposed on the downstream side.

[Sheet Binding Processing Apparatus (Post-Processing Unit)]

Figure 2:
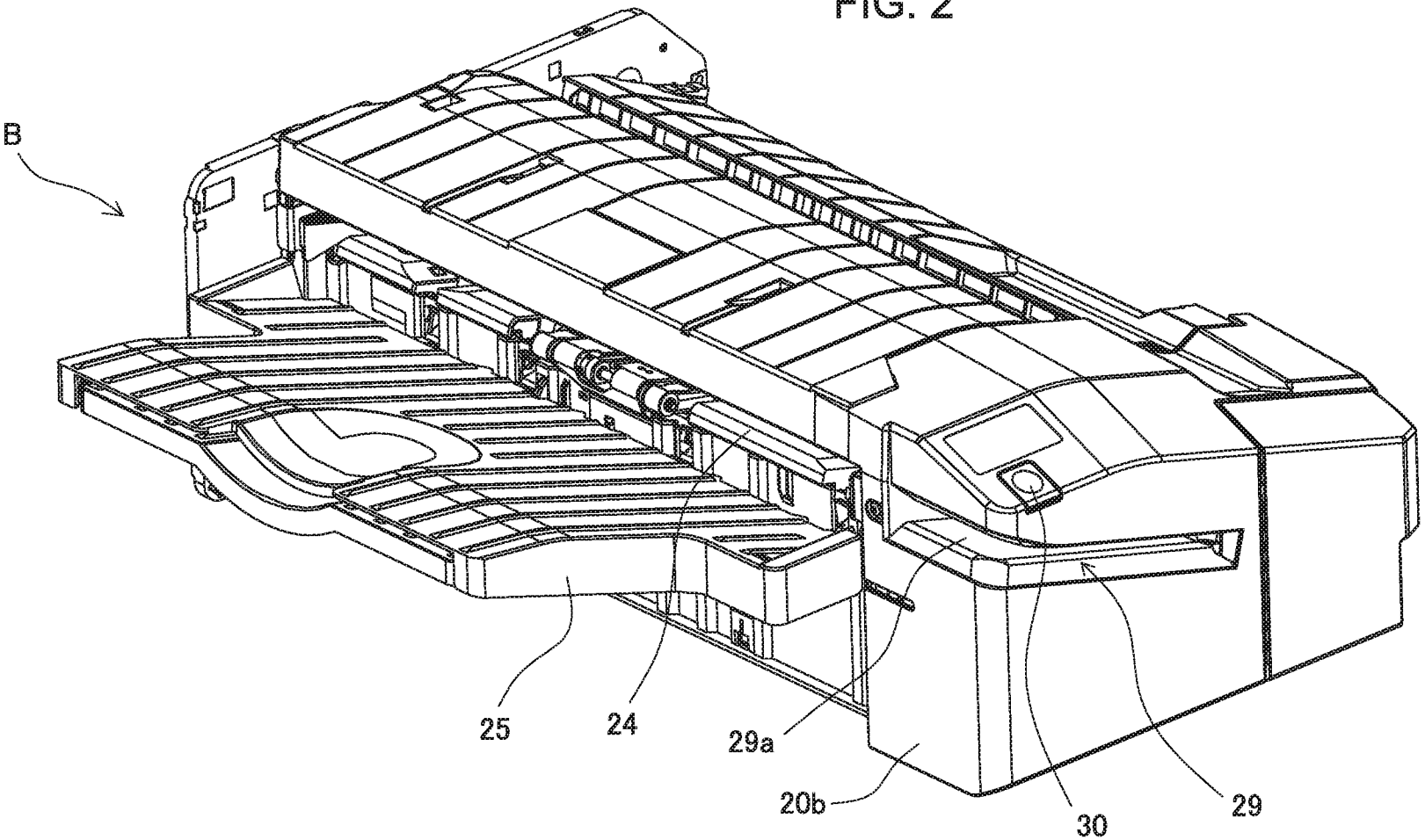
FIG. 2 shows an entire perspective view of the post-processing apparatus.
Figure 3:
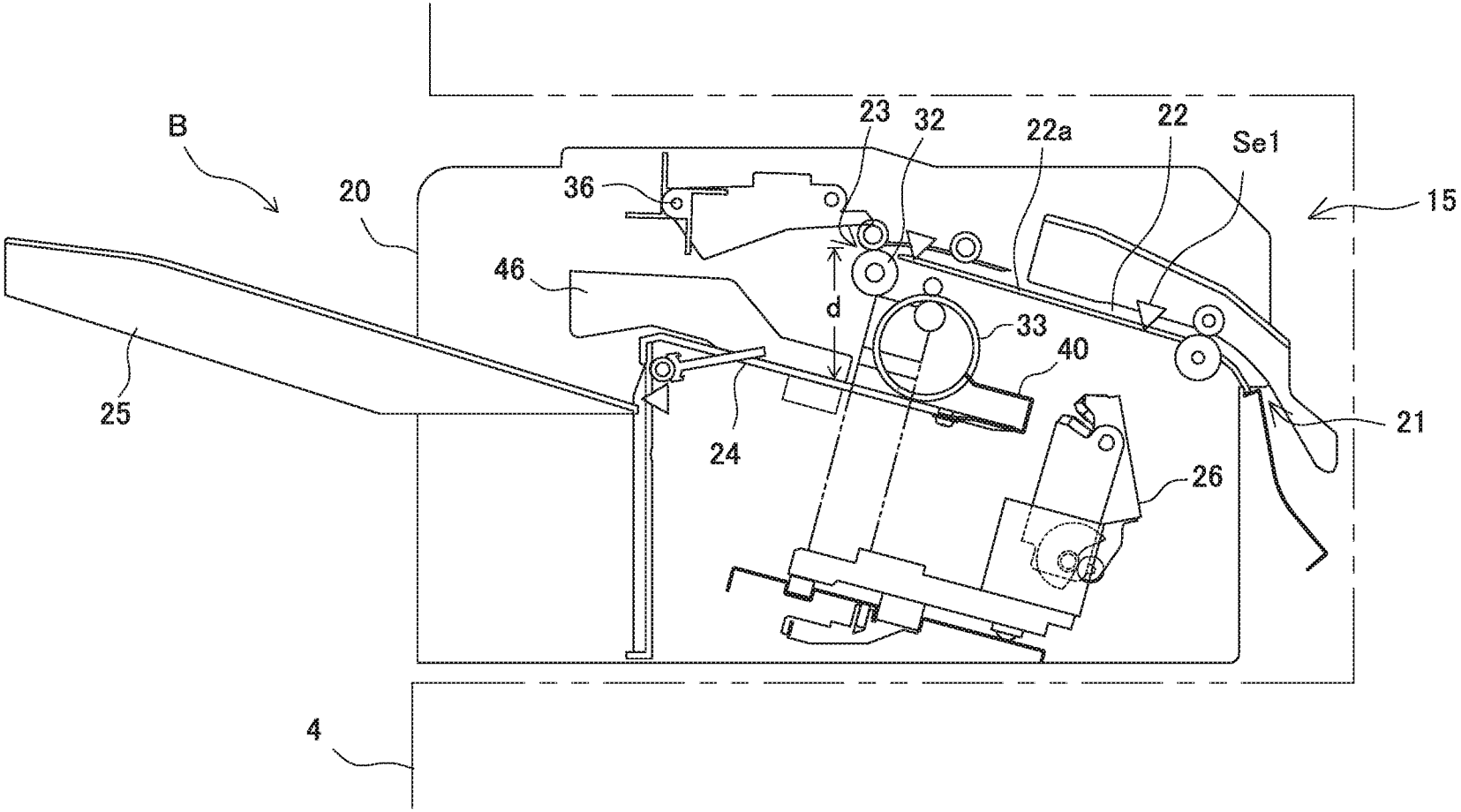
FIG. 3 shows a side elevational view of the inside of the post-processing apparatus.

FIG. 2 illustrates a perspective configuration of the post-processing unit B, and FIG. 3 illustrates a sectional configuration of the unit B. As shown in the figures, the post-processing unit B is comprised of an apparatus housing 20, a sheet carry-in path 22 disposed in the housing, the processing tray 24 disposed on the downstream side of a sheet discharge outlet 23 of the path, and the stack tray 25 disposed on the downstream side of the tray 24. The processing tray 24 is a placement section on which a bunch of sheets is placed, and is to make a bunch of sheets by collating and collecting sheets sent from the sheet discharge outlet 23.

In the processing tray 24 are disposed sheet carry-in means 36 for carrying a sheet in, sheet regulating means 40 for collecting carried-in sheet in the shape of a bunch, and aligning means 45. Together with the means, in the processing tray 24 is disposed a crimp binding apparatus 26 for performing crimp binding on a bunch of sheets. Each configuration will be described below in detail.

[Apparatus Housing]

The apparatus housing 20 is comprised of an apparatus frame 20*a*, and exterior casing 20*b*, and on the front side of the exterior casing 20*b* are equipped a manual set section 29 described later, and a manual operation button 30 (shown in the figure is a switch with an integrated display lamp).

[Transport Section]

In the apparatus housing 20 described above, as shown in FIG. 3, a transport section 22 of the sheet having a carry-in entrance 21 and sheet discharge outlet 23 is disposed, and the section shown in the figure is configured to receive the sheet in the horizontal direction to transport substantially in the horizontal direction, and carry out from the sheet discharge outlet 23. The transport section 22 is formed of an appropriate paper guide (plate) 22*a*, and includes an integrated feeder mechanism for transporting the sheet. The feeder mechanism is comprised of transport roller pairs at predetermined intervals corresponding to a path length. In the mechanism shown in the figure, a carry-in roller pair 31 is disposed in the vicinity of the carry-in entrance 21, and a sheet discharge roller pair 32 is disposed in the vicinity of the sheet discharge outlet 23. Further, in the transport section 22 is disposed a sheet sensor Se for detecting a front end and/or rear end of the sheet.

[Processing Tray]

The description will be given according to FIGS. 3 and 4. In the sheet discharge outlet 23 of the transport section 22, the processing tray 24 is disposed on the downstream side of the outlet with a height difference d formed. In order to stack sheets sent from the sheet discharge outlet 23 upward to collect in the shape of a bunch, the processing tray 24 is provided with a paper mount face 24*a* for supporting at least a part of the sheet. The apparatus shown in the figure adopts a structure (bridge support structure) where the stack tray 25 described later supports the sheet front side, and the processing tray 24 supports the sheet rear end side. By this means, tray dimensions are made smaller.

The above-mentioned processing tray 24 is configured to collect sheets sent from the sheet discharge outlet 23 in the shape of a bunch, align in a predetermined posture, then perform the binding processing, and carry out the processed bunch of sheets to the stack tray 25 on the downstream side. Therefore, into the processing tray 24 are incorporated a "sheet carry-in mechanism 33", "sheet aligning mechanism 45", "crimp binding apparatus 26" and "sheet bunch carrying-out mechanism 60".

[Sheet Carry-In Mechanism (Sheet Carry-In Means)]

The processing tray 24 is disposed in the above-mentioned sheet discharge outlet 23 with the height difference d formed. On the processing tray 24 is needed the sheet carry-in means 36 for smoothly transporting the sheet in a correct posture. The sheet carry-in means 36 (friction rotating body) shown in the figure is comprised of a paddle rotating body that moves up and down, and in a stage in which the sheet rear end is carried out onto the tray from the sheet discharge outlet 23, the paddle rotating body transfers the sheet in a sheet discharge opposite direction (rightward in FIG. 3), and strikes the sheet end regulating means 40 described later to align (position).

[Take-In Rotating Body (Take-In Transport Means)]

In the case of transporting the sheet to a predetermined position of the processing tray 24 by the sheet carry-in means 36 (paddle rotating body) disposed in the above-mentioned sheet discharge outlet 23, the take-in transport means 33 is required which guides the sheet front end to the regulating stopper 40 on the downstream side, due to effects of the curled sheet, skewed sheet and the like.

[Side Alignment]

In the processing tray 24 is disposed a sheet aligning mechanism 46 for positioning the carried-in sheet in a predetermined position (processing position). The sheet aligning mechanism 46 aligns a width in a sheet discharge orthogonal direction (sheet side direction) together with the "regulating stopper 40" described previously. The side aligning member 46 aligns the sheet on the processing tray 24 in center reference. Then, corresponding to the binding processing, in multi-binding, a bunch of sheets aligned in the shape of a bunch in center reference is subjected to the binding processing in the aligned posture in binding positions Ma1, Ma2 by the crimp binding apparatus 26. In right-left corner binding, a bunch of sheets is offset in the right-left direction by a predetermined amount, and is subjected to the binding processing in binding positions Cp1, Cp2 by the crimp binding apparatus 26.

[Sheet Bunch Carrying-Out Mechanism]

Figure 5A:
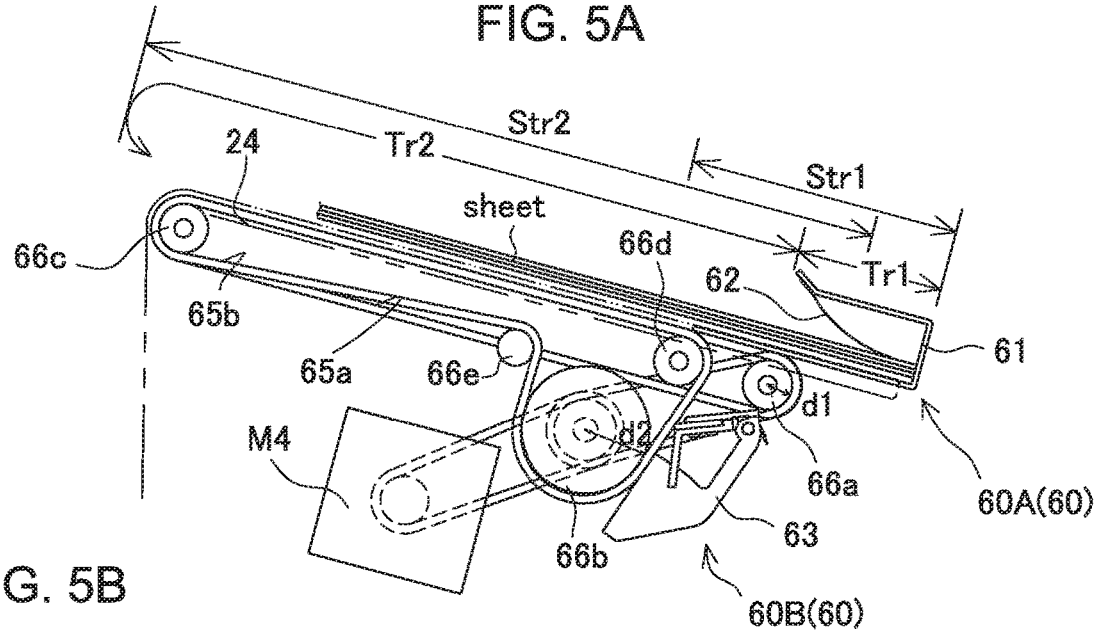
FIGS. 5A to 5D show operation explanatory views of sheet discharge means.

The sheet bunch carrying-out mechanism (sheet bunch carrying-out means 60) shown in FIGS. 5A to 5D will be described. In the above-mentioned processing tray 24 is disposed the sheet bunch carrying-out mechanism for carrying out the bunch of sheets subjected to the binding processing by the crimp binding apparatus 26 to the stack tray 25 on the downstream side. In FIG. 5A, in the processing tray 24, a first sheet rear end regulating member 41A is disposed in a sheet center Sx, and to the right and left of the member 41A, second and third sheet rear end regulating members 41B, 41C are disposed, while being spaced apart. Then, it is configured that the bunch of sheets locked by the regulating members 41 is carried out to the stack tray 25 on the downstream side, after performing the binding processing on the sheets by the crimp binding apparatus 26.

Therefore, the sheet bunch carrying-out means 60 is disposed in the processing tray 24 along the paper mount face 24*a*. The sheet bunch carrying-out means 60 shown in the figure is comprised of a first transport member 60A and second transport member 60B, the first transport member 60A performs relay transport in a first zone L1 on the processing tray, and the second transport member 60B performs relay transport in a second zone L2. Thus, by relay-transporting the sheet by the first and second transport members 60A, 60B, it is possible to make a mechanism of each transport member a different structure. Then, it is necessary that a member for transporting the bunch of sheets from almost the same starting point as that of the sheet rear end regulating means 40 is comprised of a member (long support member) with less swaying, and that a member for dropping the bunch of sheets into the stack tray 25 at a transport endpoint is small in size (because of traveling in a loop trajectory).

The first transport member 60A is comprised of a first carrying-out member 61 formed of a bent piece of channel-shaped cross section, and this member is provided with a locking face 61*a* for locking a rear end face of the bunch of sheets, and a paper surface press member 62 (elastic film member; Mylar piece) for pressing the top face of the sheet locked on the face 61*a*. Since the first transport member 60A is comprised of the channel-shaped bent piece as shown in the figure, when the member 60A is fixed to a carrier member 65*a* (belt) described later, the member 60A swings little, travels integrally with the belt, and shifts (feeds out) the rear end of the bunch of sheets in a transport direction. Then, the first transport member 60A does not travel in a curved loop trajectory as described later, and reciprocates at a stroke Str1 in an almost linear trajectory.

The second transport member 60B is comprised of a claw-shaped second carrying-out member 63, and is provided with a locking face 63*a* for locking the rear end face of the bunch of sheets, and a paper surface press member 64 for pressing the top face of the bunch of sheets. The paper surface press member 64 is axially supported by the second carrying-out member 63 swingably, and is provided with a paper surface press face 64*a*, and the paper surface press face is biased by a biasing spring 64*b* so as to press the top face of the bunch of sheets.

Figure 5B:
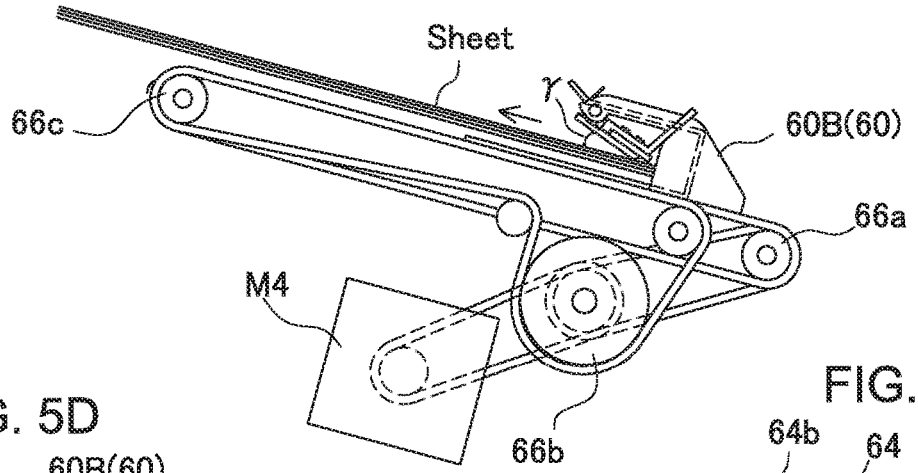
Figure 5C:
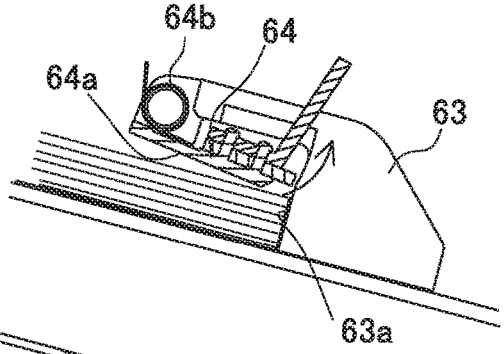
Figure 5D:
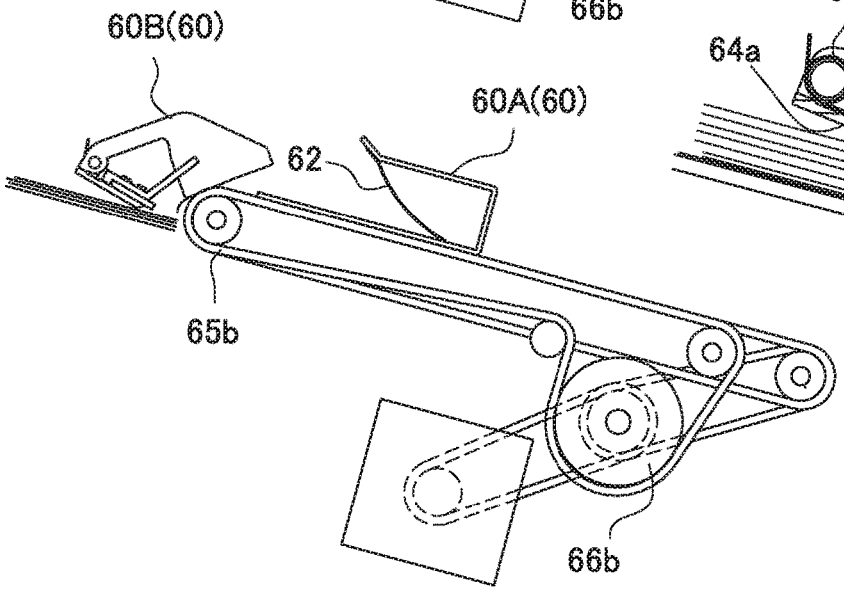

Further, the paper surface press face 64*a* is comprised of an inclined face inclined in a travel direction as shown in the figure, and in shifting in the arrow direction shown in FIG. 5B, engages in the rear end of the sheet at a nip angle of y. At this point, the paper surface press face 64*a* deforms upward (counterclockwise direction shown in the figure) in the arrow direction against the biasing spring 64*b*. Then, as shown in FIG. 5C, by action of the biasing spring 64*b*, the paper surface press face 64*a* presses the top face of the bunch of sheets to the paper mount face side.

The first carrying-out member 61 configured as described above reciprocates from a base end portion to an exit end portion of the paper mount face 24*a* by a first carrier member 65*a*, and the second carrying-out member 63 reciprocates from the base end portion to the exit end portion by a second carrier member 65*b*. Therefore, in the paper mount face 24*a*, drive pulleys 66*a*, 66*b* and driven pulley 66*c* are disposed in positions spaced a transport stroke. Notations of 66*d*, 66*e* shown in the figure are idle pulleys.

Then, the first carrier member 65*a* (shown in the figure is a belt with teeth) is looped between the drive pulley 66*a* and the driven pulley 66*c*, and the second carrier member 65*b* (belt with teeth) is looped between the drive pulley 66*b* and the driven pulley 66*c* via the idle pulleys 66*d*, 66*e*. The drive pulleys 66*a*, 66*b* are coupled to a drive motor M4, and in order to transfer rotation of the motor to the first carrier member 65*a* at a low velocity, while transferring to the second carrier member 65*b* at a high velocity, a first drive pulley 66*a* is formed in a small diameter, while a second drive pulley 66*b* is formed in a large diameter.

In other words, to the common drive motor M4, the first transport member 60A is coupled to travel at a low velocity, and the second transport member 60B is coupled to travel at a high velocity, via a deceleration mechanism (belt-pulley, gear coupling, etc.)

[Binding Processing Method (Binding Position)]

The sheet sent to the carry-in entrance 21 of the transport section 22 as described above is collated and collected on the processing tray 24, and is positioned (aligned) in beforehand set position and posture by the sheet end regulating member 40 and side aligning member 46. Then, this bunch of sheets is subjected to the binding processing, and is carried out to the stack tray 25 on the downstream side.

[Crimp Binding Apparatus Shift Mechanism]

Figure 4:
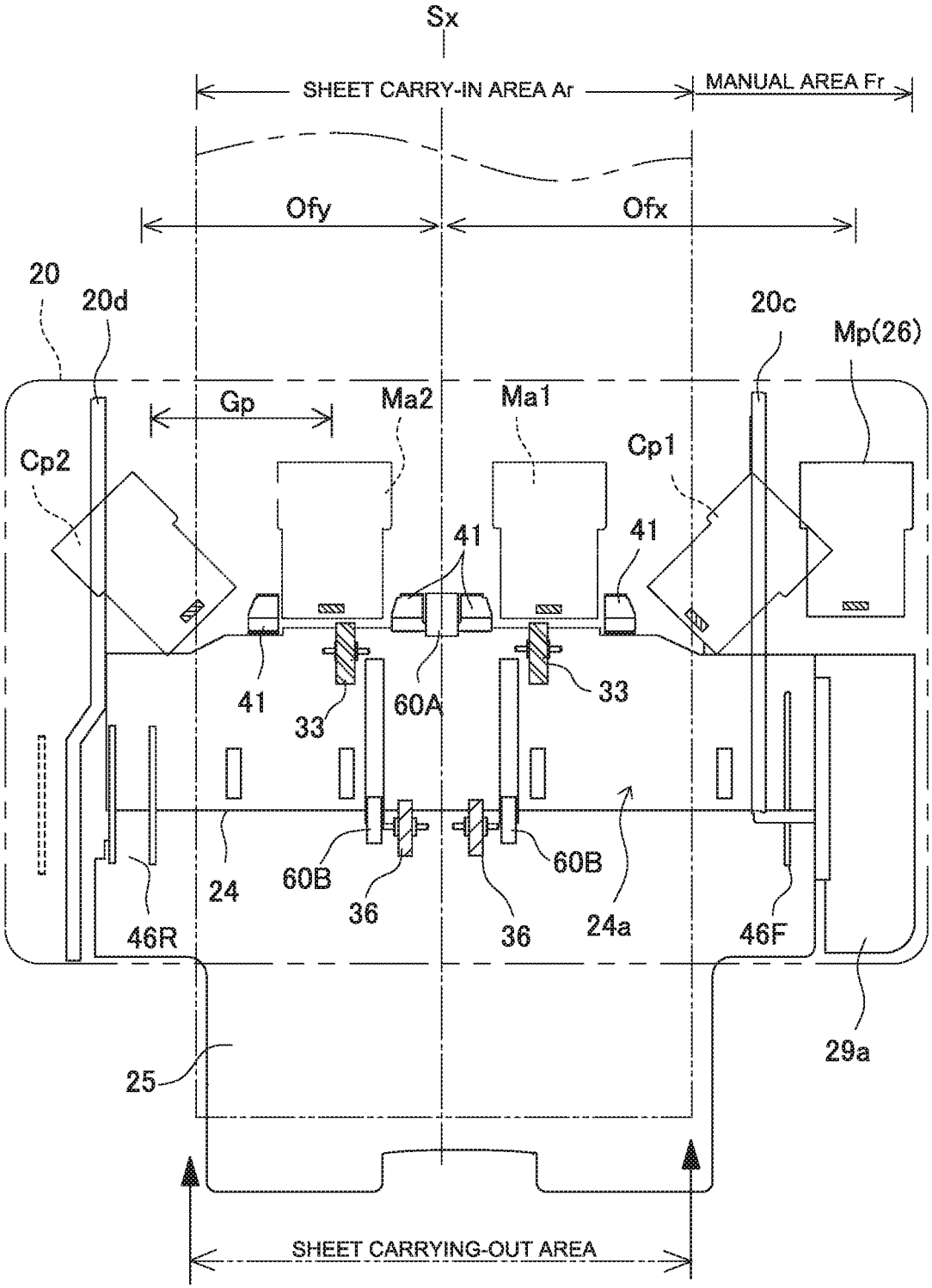
FIG. 4 shows a top view of the inside of the post-processing apparatus.
Figure 7:
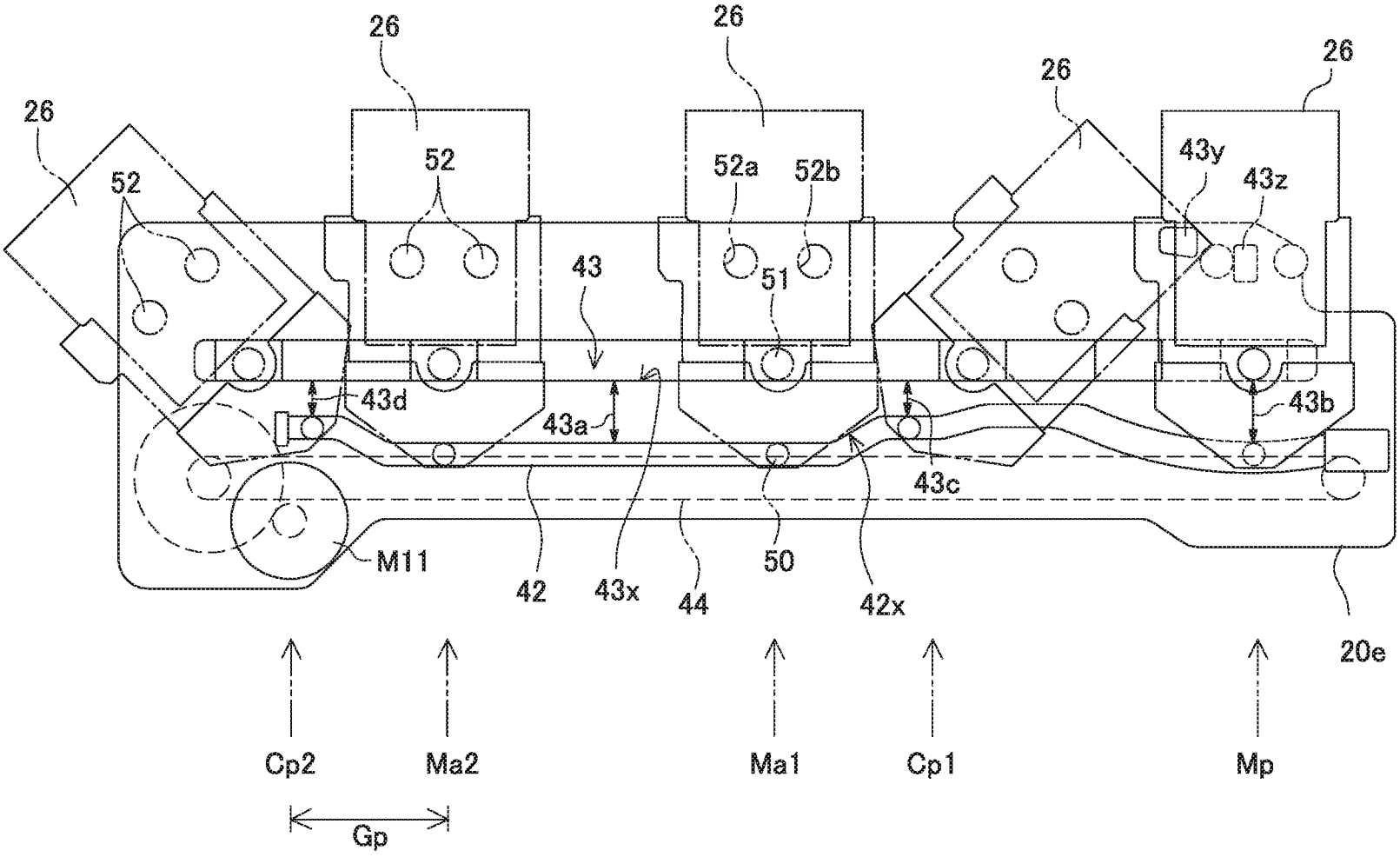
FIG. 7 shows a view to explain a shift state of a crimp binding apparatus.

As shown in FIGS. 4 and 7, the crimp binding apparatus 26 is configured to be able to shift to "multi-binding positions Ma1, Ma2", "corner binding positions Cp1, Cp2" for performing the binding processing at sheet corners, and "manual binding position Mp" for performing the binding processing on manually set sheets. This shift mechanism is conventional techniques using the so-called rail mechanism as disclosed in Japanese Patent Application Publication No. 2015-016970 and the like, and therefore, the description thereof is omitted. Further, as well as the rail mechanism, it is possible to adopt various shift methods such as a configuration for rotating the crimp binding apparatus 26 using an actuator such as a motor, and thereby changing a binding angle.

Further, as shown in FIG. 2, besides a series of post-processing operation for carrying in sheets from the transport section 22 to collate and collect, and then, performing the binding processing, the system is provided with a configuration to perform the binding processing (hereinafter, referred to as "manual staple processing") on sheets prepared outside the apparatus (outside the system).

Therefore, the manual set section 29 to set a bunch of sheets from the outside is disposed in the exterior casing 20*b*, a manual set face 29*a* to set a bunch of sheets is formed in the casing (see FIG. 2), and the crimp binding apparatus 26 described previously is configured to be able to shift in position from a sheet carry-in area Ar of the processing tray 24 to a manual area Fr.

FIGS. 6A to 6D show each binding processing position, and the crimp binding apparatus 26 is set for the "multi-binding positions Ma1, Ma2" for performing the binding processing in a plurality of portions of the sheet, "corner binding positions Cp1, Cp2" for performing the binding processing at sheet corners, and "manual binding position Mp" for performing the binding processing on manually set sheets.

[Crimp Binding Apparatus]

The crimp binding apparatus 26 will be described with reference to FIGS. 8 to 10. The crimp binding apparatus 26 presses, deforms a bunch of a plurality of sheets S collected in the shape of a bunch so as to mutually mesh, and thereby binds. Therefore, the crimp binding apparatus 26 is comprised of a cramp mechanism for cramping and deforming a bunch of a plurality of sheets S.

The apparatus is comprised of a pair of press faces 131, 141 for nipping and pressing the bunch of sheets S in the shape of a bunch from frontside and backside directions, a pair of press members 130, 140 provided with these press faces, and a drive mechanism (drive means) PM for shifting the press face of one of the press members from a waiting position Wp (non-pressing position; the same hereinafter) separated from the sheet to a pressing position Ap for pressing the sheet. The cramp mechanism in FIG. 8 is comprised of the fixed-side press member 130 having the press face 131 on the fixed side, the movable-side press member 140 having the movable-side press face 141, and the drive mechanism PM for shifting the movable-side press face from the waiting position Wp (FIG. 9A) separated from the bunch of sheets S to the pressing position Ap (FIG. 9B) for pressing the bunch of sheets S.

The fixed-side press member 130 (hereinafter, referred to as "fixed member") and movable-side press member 140 (hereinafter, referred to as "movable member") are configured to cramp the bunch of sheets S supported on the press face 131 (hereinafter, referred to as "fixed face") of the fixed member 130 by the press face 141 (hereinafter, referred to as "movable face") of the movable member 140. Therefore, the movable member 140 is axially supported swingably about a spindle 142 as the center, and the spindle 142 is fixed to the fixed member 130. Without being limited to the fixed member 130, the spindle 142 may be fixed to another member such as a unit frame 146.

Further, the fixed member 130 is fixed to the unit frame 146 integrally. Then, by action that the movable member 140 performs swing motion about the spindle 142 as the center, the fixed face 131 and movable face 141 shift in position between a pressing state (pressing position Ap; see FIG. 9B) for cramping the bunch of sheets S and a non-pressing state (waiting position Wp; see FIG. 9A) separated (apart) from the bunch of sheets S.

Figure 8:
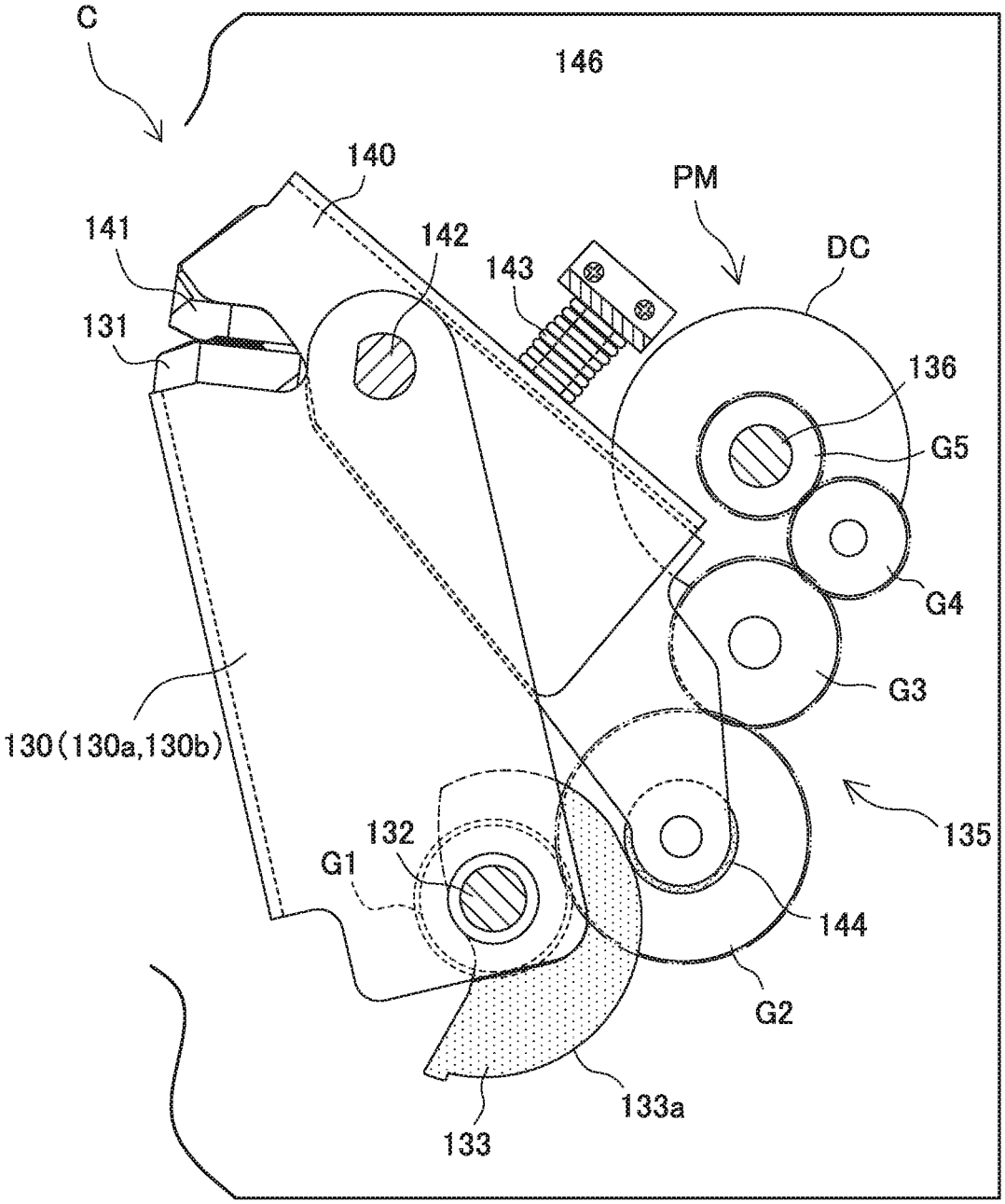
FIG. 8 shows a side elevational view of the crimp binding apparatus.

In the apparatus shown in FIG. 8, the fixed member 130 is formed of a frame member of C-shaped cross section, and the movable member 140 is supported between side walls 130*a*, 130*b* of the member 130 by the spindle 142 swingably. Thus, the movable member 140 is guided by the side walls 130*a*, 130*b* of the fixed member 130 to perform swing motion around the spindle 142 as the center. Then, in the movable member 140 is disposed a return spring 143 for biasing to the waiting position side. The return spring 143 is disposed between the member and the unit frame 146 (or fixed member 130).

Figures 9A, 9B, 9C:
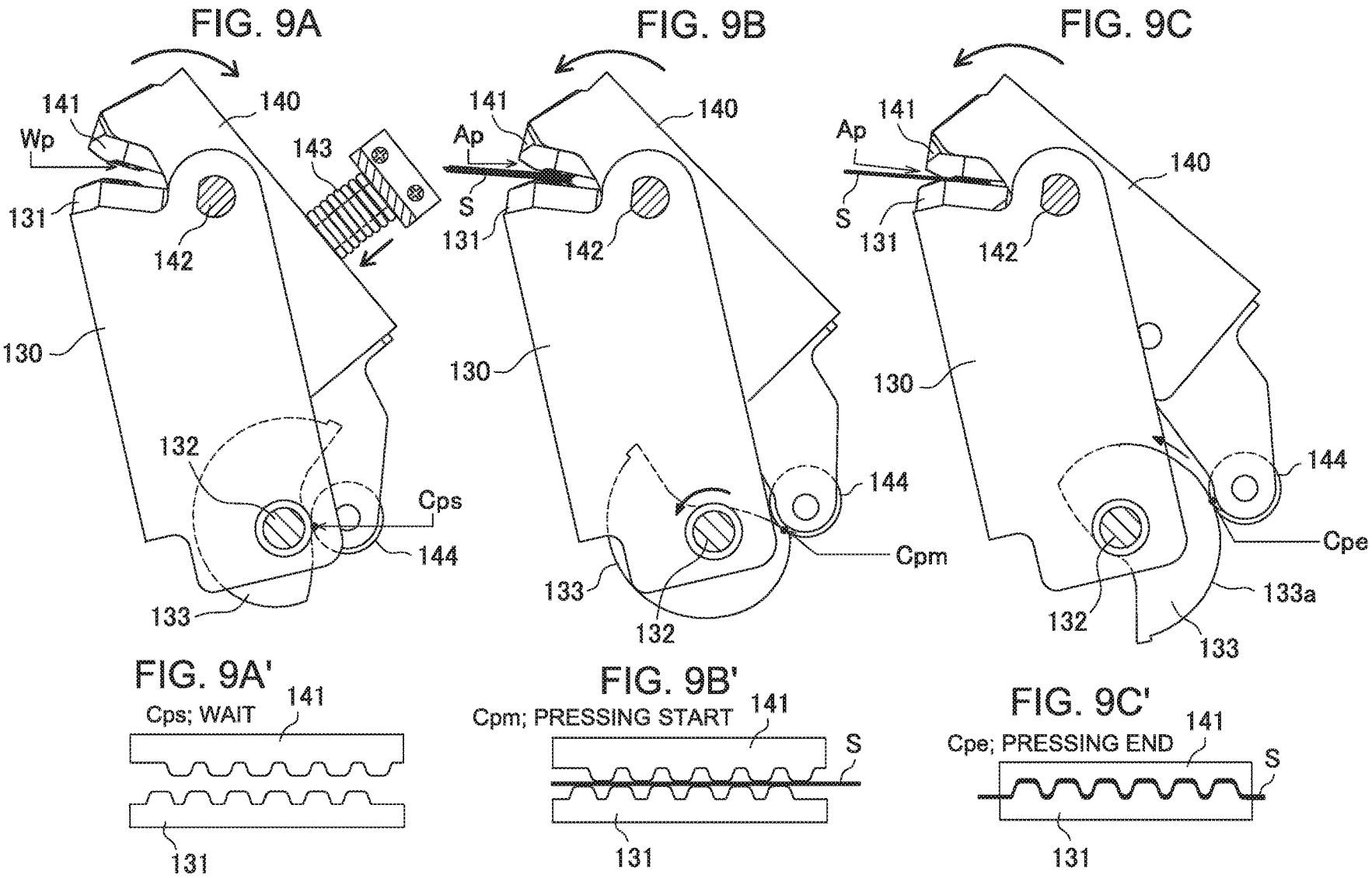
FIGS. 9A to 9C' show explanatory views of crimp binding operation.

At least one of the fixed face 131 and movable face 141 is comprised of a concavo-convex face (projection-groove), and deforms the pressed bunch of sheets S (see FIG. 9A'). In the faces shown in the figure, each of the fixed face 131 and movable face 141 is formed of a concavo-convex face, and these shapes are formed so that the convex portion and the concave portion mesh with each other. In consideration of shapes (particularly, edge shape) for preventing damage to the bunch of sheets S in pressing, the shape of each concavo-convex face is configured to be an optimum shape for deforming so that concurrently overlapping sheets mesh with one another. Then, gather-shaped (wave-shaped) deformation remains in the bunch of sheets S which is nipped and pressed by the concavo-convex faces, and the overlapping sheets are tied.

A drive mechanism of the above-mentioned movable member 140 will be described. The movable member 140 supported by the fixed member swingably is comprised of the movable face 141 in its front end portion and a cam follower 144 (hereinafter, referred to as "follower roller") in its base end portion with the spindle 142 being the boundary. The movable face 141 in the front end portion and follower roller 144 are formed in a lever length for causing the action (servo mechanism) of a lever to work via the spindle 142.

Further, a cam member 133 (shown in the figure is a cylindrical cam) is disposed in a base end portion of the fixed member 130. The cam member 133 is supported by a cam axis 132, the cam axis 132 is axially supported by the fixed member 130 rotatably, and the cam member 133 and follower roller 144 are disposed in a position relationship for mutually engaging. Furthermore, rotation of a motor DC is transferred to the cam axis 132 via transmission means 135, and the axis 132 is coupled so that the cam member 133 rotates forward and backward by forward/backward rotation of the motor DC.

As shown in FIG. 8, the motor DC is mounted on the unit frame 146, and rotation of a drive shaft 136 of the motor is transferred to rotate the cam axis 132 via transmission gears G2, G3, G4, G5 constituting the transmission means 135. The cam member 133 rotates in a counterclockwise direction in FIG. 8 by the gear G1 coupled to the cam axis 132. The cam member 133 shown in the figure is configured to repeat the counterclockwise rotation (CCW) and clockwise rotation (CW) in a predetermined angle range by forward/backward rotation of the motor DC. Then, a cam face 133*a* of the cam member 133 causes the follower roller 144 and movable member 140 integrally formed therewith to perform swing motion around the spindle 142 as the center.

In the drive mechanism shown in FIG. 8, when the motor DC rotates in the counterclockwise direction, the movable member 140 swings in the counterclockwise direction around the spindle 142 as the center, and the movable face 141 shifts from the waiting position Wp to the pressing position Ap (state shown in FIG. 9C). Further, a non-engagement portion Cps (shown in FIG. 9A) is formed in the cam face 133*a*, and in this position, the movable member 140 is biased to the waiting position Wp by action of the return spring 143 without undergoing action of the cam face 133*a*.

Then, the motor DC is rotated in the clockwise direction and is halted in a position where the non-engagement portion Cps of the cam face 133*a* engages in the follower roller 144. Then, by the spring force of the return spring 143, the movable face 141 shifts from the pressing position Ap to the waiting position Wp and halts in this position.

In the "Cps (Cam Press Start)" position shown in FIG. 9A, the cam face 133*a* holds the movable face 141 in the waiting position Wp without applying the force for swinging to the follower roller 144. Further, in a "Cpm" position shown in FIG. 9B, the face 133*a* applies, to the follower roller 144, the action force such that the movable member 140 swings in the counterclockwise direction. In the vicinity (which differs corresponding to a thickness of the bunch of sheets) of the Cpm (Cam Press Middle) position, the movable face 141 starts to press the bunch of sheets S. Then, in "Cpe (Cam Press End)" shown in FIG. 9C, although the position is different corresponding to a bunch thickness of the bunch of sheets, the maximum pressing force is acted upon the bunch of sheets S, and pressing operation is finished. Subsequently, the cam face 133*a* performs return operation in the order of "Cpe", "Cpm" and "Cps" by clockwise rotation of the cam member 133.

With respect to a cam face position engaging in the follower roller 144, when such a position is in the state of "Cps", as shown in FIG. 9A', the movable face 141 is positioned in the waiting position spaced a distance apart from the fixed face 131. When such a position is in the state of "Cpm", as shown in FIG. 9B', the movable face 141 is positioned in a pressing start position for starting to press the bunch of sheets S. When such a position is in the state of "Cpe", as shown in FIG. 9C', the movable face 141 is positioned in a pressing end position for deforming the bunch of sheets S and finishing pressing.

Then, the cam face 133*a* is formed in a helical shape for gradually increasing the pressing force between an initial position (Cpm) in which the movable face 141 presses the bunch of sheets S and the pressing end position (Cpe). This is because almost the same pressing force is acted between the fixed face 131 and the movable face 141, irrespective of whether the thickness of the bunch of sheets S is different.

In other words, the pressing force applied to the bunch of sheets S is made almost uniform, by increasing a rotation angle of the cam when the thickness of the bunch of sheets S is thin, while decreasing the rotation angle when the thickness of the bunch is thick. For example, this angle control may be performed by constant current control for applying the certain voltage to the motor DC, and halting power supply to the motor when the current value reaches a predetermined value. In addition, in the present invention, the cam member 133 is not limited to the cylindrical cam shown in the figure, and may be a plate cam. Control of binding operation with a current value will be described later.

[Binding Processing in the Processing Tray]

When a sheet discharged from the image forming apparatus is discharged onto the processing tray 24, aligning processing is performed on the sheet, and based on a signal received from an image forming apparatus main body, the sheet undergoes the corner binding processing on the rear side or the front side, or the binding processing in a plurality of portions.

[Multi-Binding]

Figure 6A:
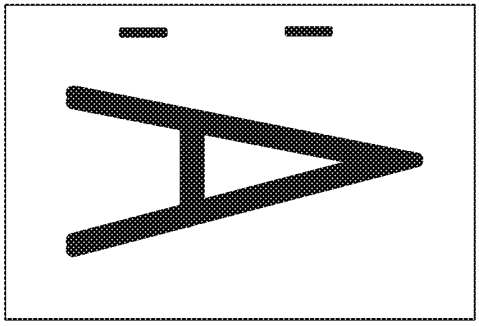
FIG. 6 shows explanatory views of respective binding processing positions.

As shown in FIGS. 4 and 7, the multi-binding processing is to perform the binding processing on the end edge (shown in the figure is the rear end edge) of a bunch of sheets (hereinafter, referred to as "aligned sheet bunch") positioned on the processing tray 24 by the sheet end regulating member 41 and side aligning member 46, and is set for the binding positions Ma1, Ma2 for performing the binding processing in two spaced portions. The crimp binding apparatus 26 described later shifts from a home position to the binding position Ma1, and next to the binding position Ma2 in this order to perform the binding processing in respective positions. In addition, the multi-binding position Ma is not limited to two portions, and there are cases of performing the binding processing in three or more portions. FIG. 6A illustrates a state subjected to multi-binding.

[Corner Binding]

Figure 6B:
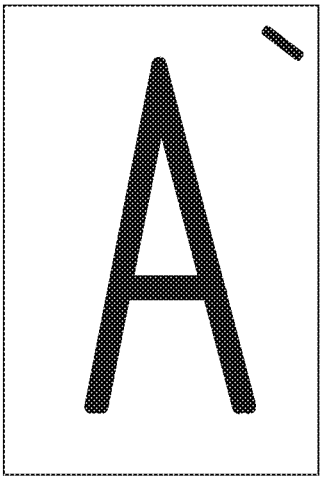
Figure 6C:
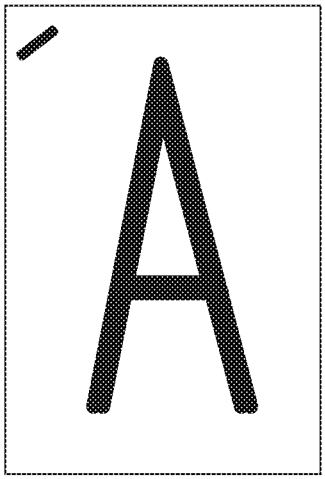
Figure 6D:
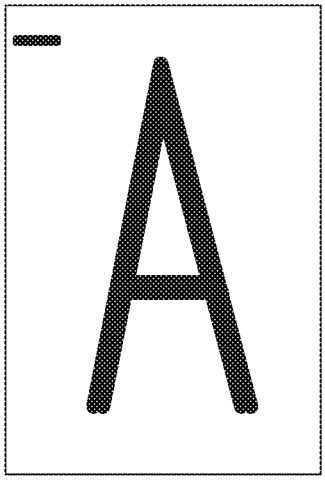

In the corner binding processing, binding positions are set at two right and left portions in the right corner binding position Cp1 for performing the binding processing on the right corner of the aligned sheet bunch collected on the processing tray 24, and left corner binding position Cp2 for performing the binding processing on the left corner of the aligned sheet bunch. In this case, the crimp binding apparatus 26 is inclined a predetermined angle (about 30 degrees to 60 degrees) to perform the binding processing. FIGS. 6B and 6C show states subjected to corner binding.

Apparatus specifications shown in the figure illustrate the case of selecting one of the left and the right of a bunch of sheets to perform the binding processing, and the case of inclining the crimp binding apparatus 26 a predetermined angle to perform the binding processing. The present invention is not limited thereto, and is capable of also adopting a configuration for applying corner binding to only one of the right and the left, and a configuration for binding parallel with the sheet end edge without inclining the crimp binding apparatus 26.

[Manual Insertion Binding Processing]

On the front side of the post-processing apparatus housing is provided the manual set section 29 to manually insert sheets from outside the apparatus housing and set on the processing tray 24. A normal waiting position of the crimp binding apparatus 26 is the manual insertion binding processing position, and the apparatus 26 returns to the manual insertion binding processing position after completing the binding processing on the processing tray 24, and thereby enables prompt processing to be performed.

[Binding Operation Control]

Figure 10:
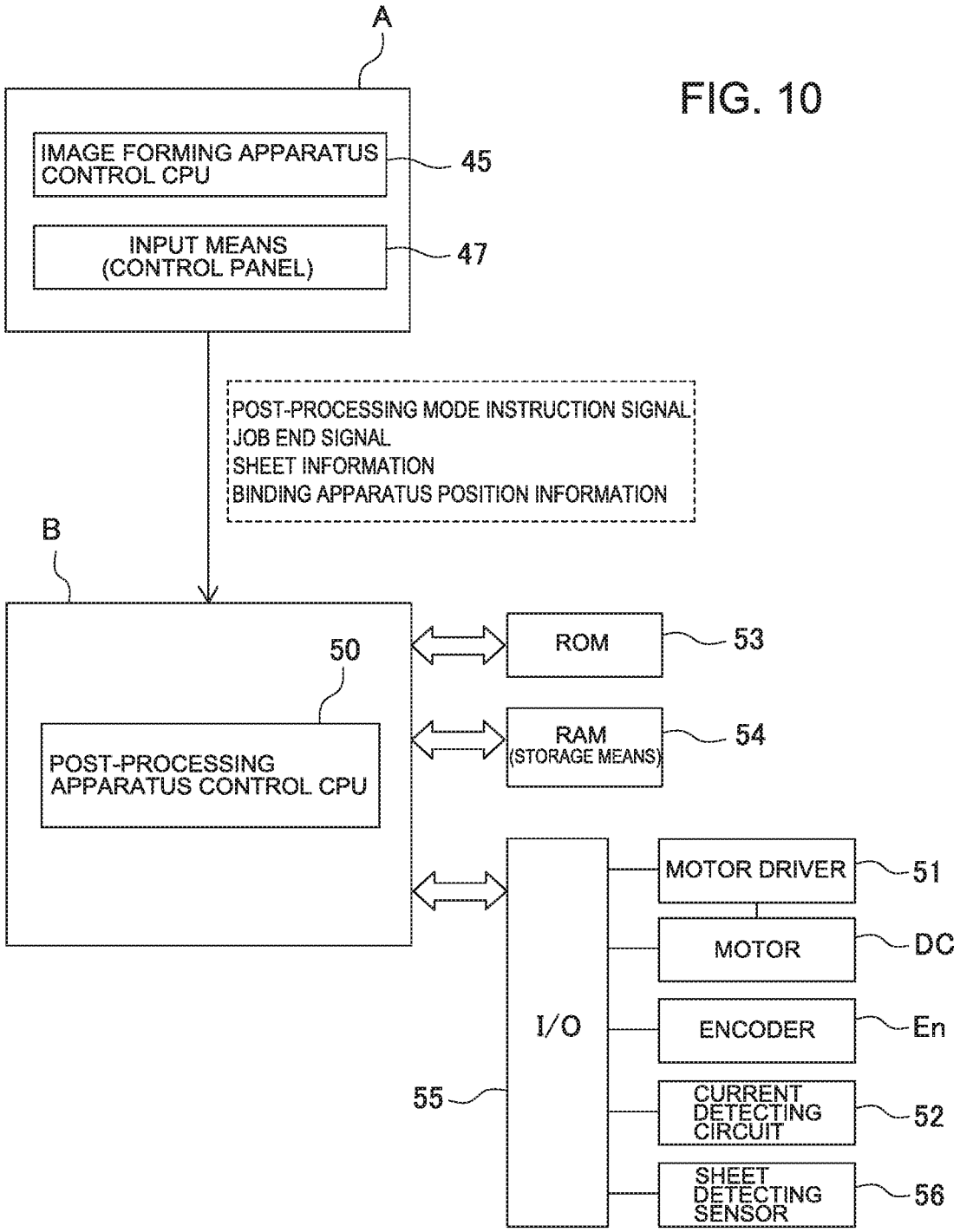
FIG. 10 illustrates a control configuration in a block diagram.

FIG. 10 is a block diagram illustrating a simplified control configuration of the image forming system. The image forming unit A is controlled by image forming apparatus control CPU 45, and the post-processing unit B is controlled by post-processing apparatus control CPU 50. The image forming unit A is provided with a mode selecting means 48 and input means 47, and the CPU 45 controls to form images on sheets according to image forming conditions and the like input to the input means 47 by a user of the image forming system, and transport to the post-processing unit B. At this point, the CPU 45 transmits the input post-processing mode and information on the designated binding position to the CPU 50 of the post-processing unit B, using a post-processing mode signal and binding apparatus position information, respectively. Further, the CPU 45 transmits a job end signal to the CPU 50 when images are formed on all sheets to transport to the post-processing unit B, and further transmits sheet information indicative of the number of sheets to transport and properties of the sheet.

The post-processing apparatus control CPU 50 executes programs stored in ROM 53 to control entire operation of the post-processing apparatus, and herein, illustrates only the configuration to perform pressing control at the time of the binding processing. The CPU 50 is coupled to a motor driver 51 of the motor DC via an I/O interface 55, an encoder En disposed in the drive shaft 136 of the DC motor, a current value detecting circuit 52 for detecting a current value of the motor DC, and a sheet detecting sensor 56 for detecting insertion of a bunch of sheets S into the manual set section 29.

Figure 11A:
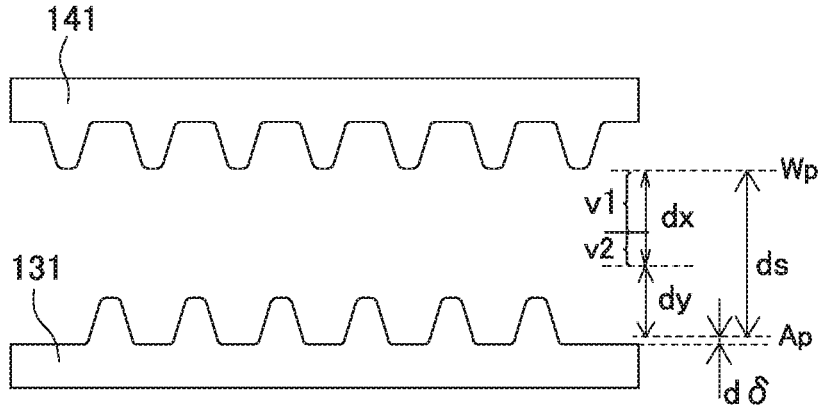
FIGS. 11A to 11E show explanatory views of binding operation.
Figure 11B:
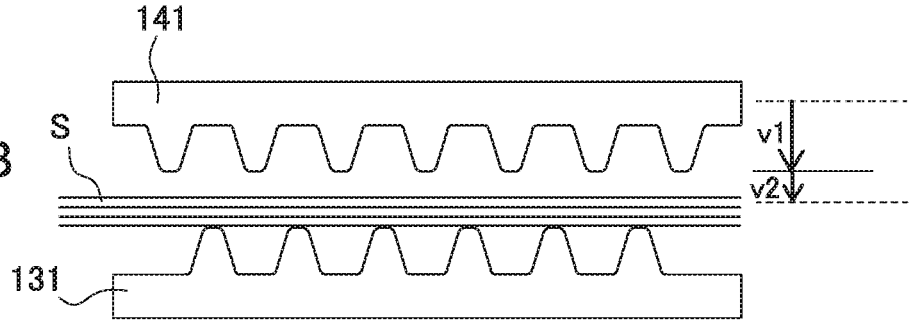
Figure 11C:
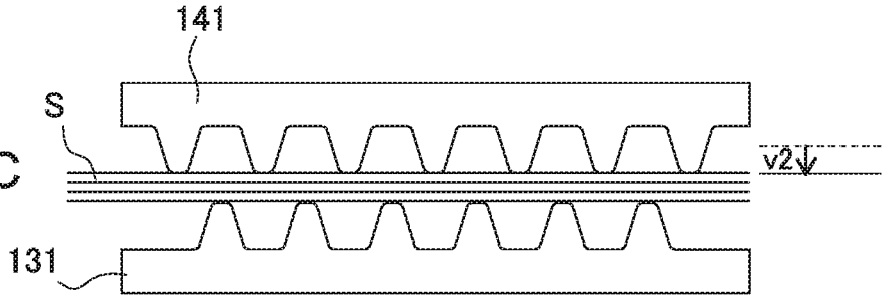
Figure 11D:
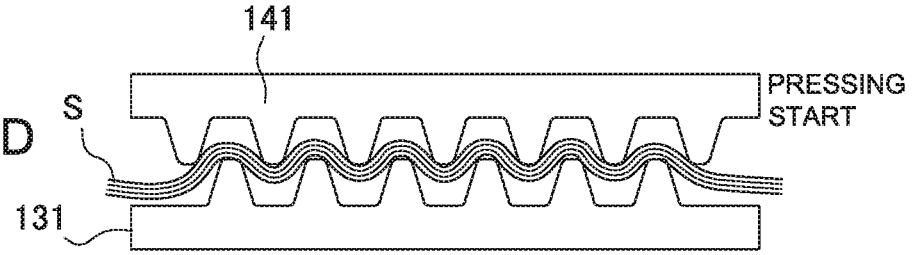
Figure 11E:
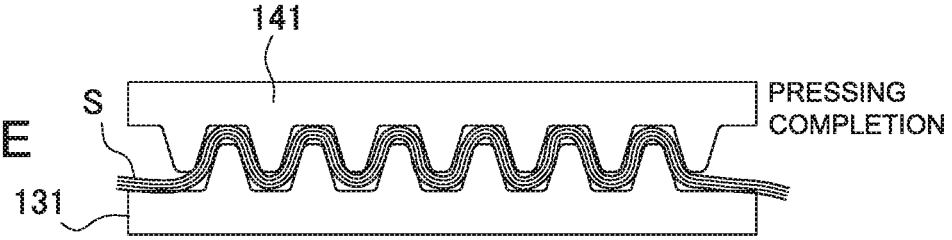

FIGS. 11A to 11E contain explanatory views of a shift stroke of the movable face 141 performed by the CPU 50 controlling drive of the motor DC, FIG. 11A illustrates a state in which the movable face 141 is positioned in the waiting position, FIG. 11B illustrates a state in which the movable face 141 starts pressing operation, FIG. 11C illustrates a state in which the movable face 141 engages in a bunch of sheets S, FIG. 11D illustrates an initial state in which the movable face 141 presses the sheets, and FIG. 11E illustrates a state in which the movable face 141 presses the bunch of sheets S by predetermined pressure, and halts movement i.e. a state in which the motor DC is driven by predetermined voltage, and the current value reaches a predetermined value.

[Stroke of the Movable Face]

By applying the beforehand set voltage to the motor DC, as shown in FIGS. 11A and 11B, the movable face 141 shifts from the waiting position Wp to the pressing position Ap for engaging in the bunch of sheets S. Its maximum stroke ds is set at a distance between the movable face 141 positioned in the waiting position Wp and the fixed face 131. Further, timing at which the movable face 141 reduces the velocity from a first set velocity v1 to a second set velocity v2 is beforehand set (design value).

The timing is configured so that the velocity is reduced from the velocity v1 to the velocity v2 when the movable face 141 arrives at a sheet-bunch maximum bunch thickness position (FIG. 11A; dy). At the timing, the CPU 50 executes deceleration operation with an encoder pulse count from the encoder En. Accordingly, the movable face 141 shifts from the state of FIG. 11B to the state of FIG. 11C at the velocity v2. In addition, in FIG. 11A, dx is (ds−dy), and indicates a shift amount by which the movable face 141 shifts to an allowable maximum bunch thickness position, and dδ indicates a position of binding processing-capable allowable minimum bunch thickness.

Then, the movable face 141 further shifts from the state of FIG. 11D, and gradually presses the bunch of sheets S to deform. However, by coming into contact with the bunch of sheets S, the shift of the movable face 141 is slower. Further, when the predetermined voltage is applied to the motor DC continuously, the bunch of sheets S is deformed in a predetermined shape, and the movable face 141 halts. Accordingly, when the CPU 50 detects that the current value is increased by the load on the motor DC and reaches a predetermined current value by the current value detecting circuit 52, the CPU 50 halts the drive of the motor DC for a predetermined time. Accordingly, during the time, the movable face 141 halts in a state of deforming the bunch of sheets S in the predetermined shape, and maintains a state of applying the predetermined pressing force to the bunch of sheets S. Then, when the movable face 141 presses the bunch of sheets S for a set pressing time, after a lapse of the pressing time, the CPU 50 rotates the motor DC in the backward direction, and shifts the movable face 141 from the pressing position Ap to the waiting position Wp.

[Adjustment of Crimp Binding Pressure]

As described previously, the cam face 133*a* has the helical shape so that the pressing force for pressing the bunch of sheets S by the movable face 141 gradually increases for a period during which an action point of the cam face 133*a* of the cam member 133 for shifting the movable face 141 by drive of the motor DC rotates from the initial position (Cpm) to the pressing end position (Cpe). Accordingly, it is possible to adjust the crimp binding pressure to the bunch of sheets S by halting rotation of the cam member 133 i.e. halting the motor DC in which position between the initial position (Cpm) and the pressing end position (Cpe).

Accordingly, by setting a detection current value by the current value detecting circuit 52 at a high value when the CPU 50 halts drive of the motor DC, the crimp binding pressure is increased. Conversely, by setting the detection current value at a low value, the crimp binding pressure is decreased.

Ordinarily, in the case of performing the binding processing inside the processing tray 24, it is necessary to discharge the processed bunch of sheets to outside the apparatus. In this case, unless the bunch is bound by sufficient fastening force, there is the risk that binding of the bunch of sheets S is untied to cause a transport jam, and therefore, it is necessary to set the pressing force at a high value so as to obtain the fastening force enduring sheet bunch transport and drop onto the stack tray 25. In contrast thereto, a bunch of sheets S inserted in the manual set section 29 undergoes the binding processing in a state in which the operator grasps by hand, and therefore, does not need to be pressed by the fastening force to the extent of enduring bunch transport.

Further, in the binding processing by crimp binding, in order to strengthen entanglement of paper fibers, it is known that a crimp binding portion of sheets is humidified (see Japanese Patent Gazette No. 6171514). This is because a sheet is significantly influenced by contained water content, and in sheets with low water content, entanglement of paper fibers is weaker and the fastening force is lower than in sheets with high water content.

The sheet transported into the processing tray 24 is dried by heat receiving from a fuser roller in passing at the time of image forming processing and heat inside the apparatus, and the water content is decreased. On the other hand, the sheet inserted in the manual set section 29 undergoes an effect of humidity of an installation environment, and the water content is increased. In other words, in the sheet transported into the processing tray 24, the water content is lower than the sheet inserted in the manual set section 29, and a high pressing force is required to obtain reliable fastening force.

For the above-mentioned reason, in binding sheets discharged into the processing tray 24, the need arises to apply higher pressing force than in binding sheets which are inserted into the manual set section 29 from outside the apparatus to undergo the manual insertion binding processing. In other words, the manual insertion binding processing does not need a high pressing force to the extent that sheets discharged into the processing tray 24 are bound. Also in the manual insertion binding processing, it is possible to bind by high pressing force similar to force in binding on the processing tray 24, but mechanical stress applied to the crimp binding apparatus 26 increases significantly when the binding processing is performed always under a high load, and therefore, to maintain durability, upsizing and high cost of the apparatus is not eluded. Then, by decreasing the pressing force in the manual insertion binding processing, upsizing and high cost of the apparatus is avoided to improve durability. Further, in the respect of reducing a transport jam, the effect of the present invention is obtained irrespective of whether the printing apparatus is an inkjet type or toner type, and particularly, the toner type of printing apparatus is capable of obtaining a more remarkable effect.

Accordingly, in order to change the crimp binding pressure in the case (hereinafter, referred to as "online binding") of performing crimp binding on a bunch of sheets S carried in the processing tray 24 from the sheet carry-in means 36 and in the case (hereinafter, referred to as "offline binding") of performing crimp binding on a bunch of sheets inserted into the manual set section 29, a current value p when the CPU 50 halts the motor DC is made higher than a current value q in offline binding. RAM 54 stores the current value p and the current value q, and the CPU 50 reads the current value p or the current value q corresponding to online binding or offline binding, and compares with a detection current value of the current detecting circuit 52. Further, by storing, in the RAM 54 in a data table, each current value to apply suitable pressing force corresponding to a bunch thickness and/or sheet properties of a bunch of sheets also in the case of online binding, it is possible to adjust the pressing force corresponding to a bunch thickness and/or sheet properties of a bunch of sheets.

[Crimp Processing Operation Control]

The flow of crimp binding operation will be described with reference to FIGS. 12 and 13. FIG. 12 illustrates the case of online binding, and in this case, when crimp binding and binding position of this case is designated from the input means 47 by a user of the image forming system, the CPU 45 of the image forming unit A transmits a post-processing mode instruction signal and binding position information to the post-processing unit B. By this means, a binding processing job is started by the crimp binding apparatus 26 (St 01).

First, the CPU 50 of the post-processing unit B determines a binding position from the transmitted binding position information (St 02). Then, in the case of corner binding, corresponding to the binding position on the front side or the rear side, the CPU 50 shifts the crimp binding apparatus 26 to the front-side corner binding position (St 03) or the rear-side corner binding position on the rear side (St 04).

Then, when the predetermined number of sheets is discharged to the processing tray 24 and is aligned (St 05), the motor DC is driven to start the press crimp processing by the crimp binding apparatus 26 (St 06).

Completion of crimp binding is determined by detecting the load imposed on the motor DC of the crimp binding apparatus 26 i.e. an increase in the current value, and when the current value reaches the predetermined current value p described previously ("Y" in St 07), the motor DC is halted to complete pressing operation (St 08). Then, after a lapse of a predetermined pressing time, the motor DC is rotated in the backward direction. Until the action point of the cam face 133*a* of the cam member 133 returns to the non-engagement portion Cps, the motor DC is rotated in the backward direction to separate the movable member 140 from a bunch of sheets S (St 19). Then, the bound bunch of sheets S is discharged to the stack tray 25, and the job is ended (St 20).

On the other hand, when it is determined that the binding position is of two-portion binding from the transmitted binding position information (St 02), the crimp binding apparatus 26 is shifted to one of the positions corresponding to two-portion binding (St 09). When the predetermined number of sheets is discharged to the processing tray 24 and is aligned (St 10), the motor DC is driven to start the press crimp processing by the crimp binding apparatus 26 (St 11).

Completion of this crimp binding is also determined by detecting the load imposed on the motor DC of the crimp binding apparatus 26 i.e. an increase in the current value, and when the current value reaches the predetermined current value p ("Y" in St 12), the motor DC is halted to complete pressing operation in the first portion (St 13). Then, after a lapse of a predetermined pressing time, the motor DC is rotated in the backward direction. Until the action point of the cam face 133*a* of the cam member 133 returns to the non-engagement portion Cps, the motor DC is rotated in the backward direction to separate the movable member 140 from a bunch of sheets S (St 14).

Next, the crimp binding apparatus 26 is shifted to the binding position in the second portion (St 15), and press crimp by the crimp binding apparatus 26 is started (St 16). Similarly, when the current value reaches the predetermined current value p ("Y" in St 17), the motor DC is halted to complete pressing operation in the second portion (St 18). Then, the motor DC is rotated in the backward direction. Until the action point of the cam face 133*a* of the cam member 133 returns to the non-engagement portion Cps, the motor DC is rotated in the backward direction to separate the movable member 140 from a bunch of sheets S (St 19). Accordingly, the movable member 140 is separated to a retract position, and separates from the bunch of sheets (St 20), the bunch of sheets S with crimp in two portions finished is discharged to the stack tray 25, and the job is ended (St 20).

Figure 13:
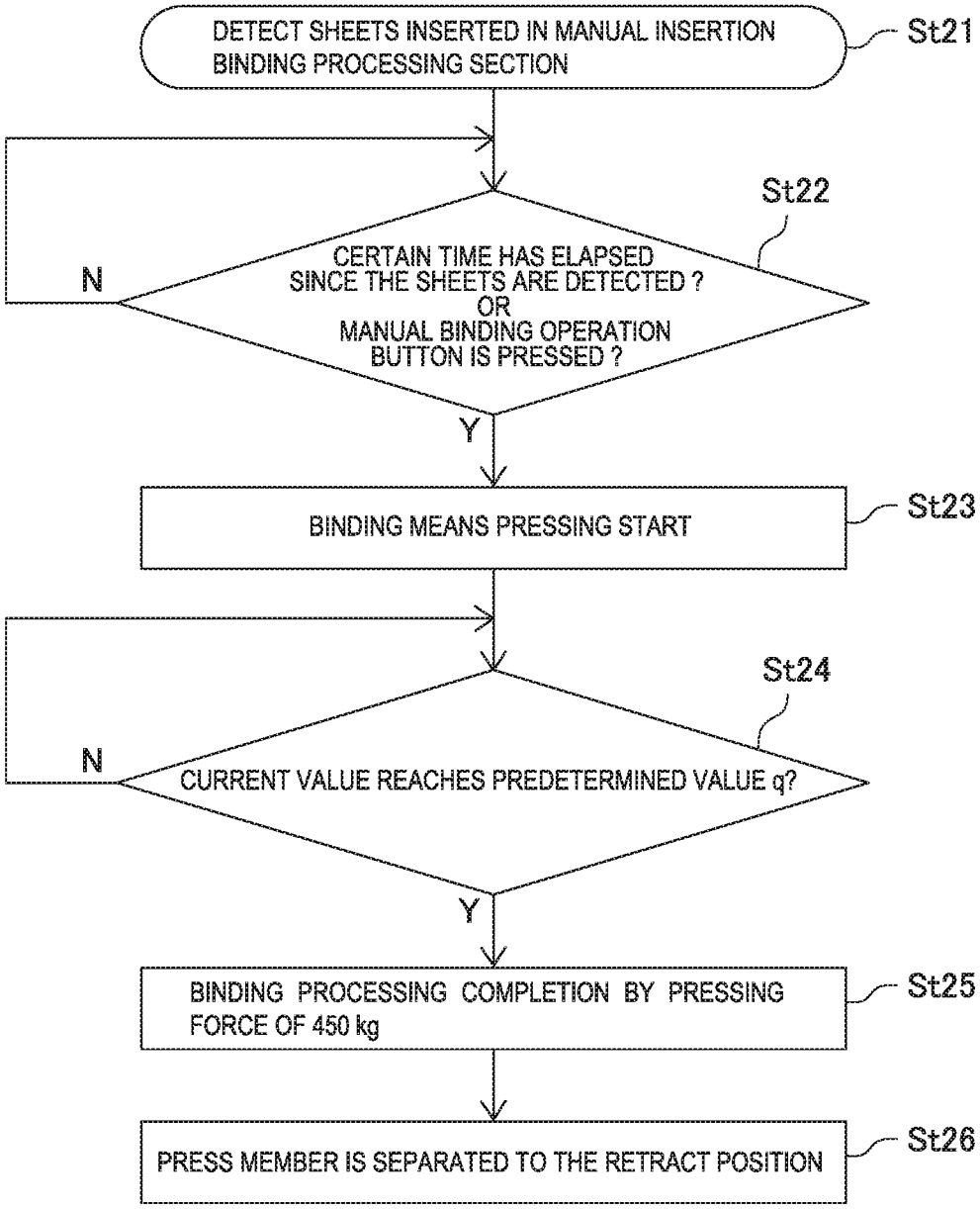
FIG. 13 shows an operation flow diagram of manual insertion binding.

FIG. 13 illustrates the case of offline binding, and in this case, when sheets are inserted in the manual set section 29, the job is started based on ON information of the sheet detecting sensor 56 (St 21). By pressing the manual operation button 30 (shown in FIG. 2) after setting sheets in the manual insertion binding processing position or after a predetermined time has elapsed since the sheets are set (St 22), the motor DC is driven to start the press crimp processing by the crimp binding apparatus 26 (St 23).

Completion of crimp binding is determined by detecting the load imposed on the motor DC of the crimp binding apparatus 26 i.e. an increase in the current value, and in this case, when the current value reaches the current value q that is a smaller value than the current value p ("Y" in St 24), the motor DC is halted to complete pressing operation (St 25). Then, the motor DC is rotated in the backward direction. Until the action point of the cam face 133*a* of the cam member 133 returns to the non-engagement portion Cps, the motor DC is rotated in the backward direction to separate the movable member 140 from a bunch of sheets S (St 26). Accordingly, it is possible to pull out the bunch of sheets S with crimp binding finished from the manual binding section.

In addition, in this Embodiment, with respect to the pressing force of the crimp binding apparatus 26, in the case of setting at a predetermined value A, the sheet is pressed by the pressing force of about 600 KG. In the case of setting at a predetermined value B, the sheet is pressed by the pressing force of about 450 KG (the extent of about 75% of the predetermined value A). The pressing force described above is a reference value based on the shape of the binding teeth and the like in this Embodiment. According to experiments of the inventor of this application, it is desirable that the predetermined value B is set at the extent of 75% of the predetermined value A.

Further, in this Embodiment, the configuration is described where the manual set section is provided in a position different from that of the processing tray, and also in the case of adopting the publicly known configuration where the manual set section and processing tray are in a common position, or the case of adopting the publicly known configuration where the manual set section and processing tray are respectively provided with crimp binding apparatuses, by making the pressing force different between the case with sheet transport and the case without sheet transport like the present invention, it is possible to apply suitable pressing forces.

This application claims priority based on Japanese Patent Application No. 2018-187155 (filed on Oct. 2, 2018), entire content of which is expressly incorporated by reference herein.

What is claimed is:

1. A sheet binding processing apparatus comprising:

a transport section adapted to transport a bunch of sheets in a predetermined transport direction;

a sheet discharge outlet adapted to discharge the bunch of sheets transported from the transport section;

a placement section adapted to place the bunch of sheets discharged from the discharge outlet;

a manual set section adapted to enable a bunch of sheets inserted in a direction different from the transport direction to be set;

a press member adapted to press the bunch of sheets placed on the placement section or the bunch of sheets placed on the manual set section to bind;

a drive section adapted to apply a pressing force to the press member; and a control section adapted to control the drive section so as to make the pressing force applied to a binding member higher in a case of binding the bunch of sheets placed on the placement section than in a case of binding the bunch of sheets set from the manual set section.

2. The sheet binding processing apparatus according to claim 1, wherein the drive section is comprised of a motor, and is provided with a cam member for converting rotation of the motor into motion of the press member.

3. The sheet binding processing apparatus according to claim 2, wherein a cam face of the cam member for biasing the press member includes a helical shape so as to gradually increase the pressing force of the press member to the bunch of sheets.

4. The sheet binding processing apparatus according to claim 3, further comprising:

a current value detecting circuit adapted to detect a current value of the motor, wherein when the current value of the motor is increased as the press member increases the pressing force by action of the cam, the control section halts drive of the motor when the current value reaches a first predetermined value in a case of the bunch of sheets which is placed on the placement section and is set from the manual set section, while in a case where the bunch of sheets is a bunch of sheets discharged from the discharge outlet, halting drive of the motor when the current value reaches a second predetermined value higher than the first predetermined value.

5. The sheet binding processing apparatus according to claim 1, wherein the manual set section is provided in a position different from that of the placement section.

6. The sheet binding processing apparatus according to claim 5, wherein the press member is provided with a shift member capable of shifting between the placement section and the manual set section.

7. The sheet binding processing apparatus according to claim 1, wherein the manual set section is also used as the placement section.

8. An image forming system comprising:

an image forming unit adapted to form an image on a sheet; and a post-processing unit adapted to collect the sheet sent from the image forming unit in the shape of a bunch to perform binding processing, wherein the post-processing unit is the sheet binding processing apparatus according to claim 1.

* * * * *